US009021719B2

(12) United States Patent
Rabushka

(10) Patent No.: US 9,021,719 B2
(45) **Date of Patent: *May 5, 2015**

(54) SHOE SPRING AND SHOCK ABSORBING SYSTEM

(71) Applicant: Mitchell Gary Rabushka, Gurnee, IL (US)

(72) Inventor: Mitchell Gary Rabushka, Gurnee, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/941,337

(22) Filed: Jul. 12, 2013

(65) Prior Publication Data

US 2014/0041253 A1 Feb. 13, 2014

Related U.S. Application Data

(63) Continuation of application No. 13/042,627, filed on Mar. 8, 2011, now abandoned, which is a continuation of application No. 11/725,368, filed on Mar. 19, 2007, now Pat. No. 7,900,376.

(60) Provisional application No. 60/783,516, filed on Mar. 17, 2006.

(51) Int. Cl.
*A43B 13/18* (2006.01)
*A43B 13/20* (2006.01)

(52) U.S. Cl.
CPC ..... *A43B 13/181* (2013.01); *A43B 13/183* (2013.01); *A43B 13/187* (2013.01); *A43B 13/189* (2013.01); *A43B 13/20* (2013.01)

(58) Field of Classification Search
USPC ..... 36/27, 28, 7.8, 38, 35 R
See application file for complete search history.

(56) References Cited

U.S. PATENT DOCUMENTS

| | | | | |
|---|---|---|---|---|
| 337,146 | A * | 3/1886 | Gluecksmann | 36/7.8 |
| 1,088,328 | A * | 2/1914 | Cucinotta | 36/28 |
| 5,138,776 | A * | 8/1992 | Levin | 36/38 |
| 5,367,790 | A * | 11/1994 | Gamow et al. | 36/27 |
| 6,029,374 | A * | 2/2000 | Herr et al. | 36/27 |
| 6,247,249 | B1 * | 6/2001 | Lindqvist | 36/28 |
| 7,100,308 | B2 * | 9/2006 | Aveni | 36/27 |
| 7,900,376 | B2 * | 3/2011 | Rabushka | 36/27 |
| 2005/0102857 | A1 * | 5/2005 | Yen | 36/28 |
| 2005/0102858 | A1 * | 5/2005 | Yen | 36/28 |
| 2005/0102859 | A1 * | 5/2005 | Yen | 36/28 |
| 2005/0166422 | A1 * | 8/2005 | Schaeffer et al. | 36/27 |
| 2011/0203132 | A1 * | 8/2011 | Rabushka | 36/27 |

* cited by examiner

*Primary Examiner* — Marie Bays

(57) ABSTRACT

Footwear with a powerful arch spring made with spring boards that can be utilized by the heel and ball of the foot areas during impact for efficient energy storage and return during walking, running and other forms of self-propelled locomotion. The spring boards can extend into the toe area of the footwear to create a toe spring with efficient energy storage and return. Embodiments of the present invention combine the spring boards which are excellent for storing and returning energy with a shock absorbing material which can also function as a secondary spring in order to achieve high efficiency energy returns while maintaining comfort and stability with the footwear.

17 Claims, 8 Drawing Sheets

SHOE SPRING AND SHOCK ABSORBING SYSTEM

RELATED APPLICATIONS

The present patent document is a continuation of application Ser. No. 13/042,627, filed Mar. 8, 2012, which is a continuation of application Ser. No. 11/725,368, filed Mar. 19, 2007, issued as U.S. Pat. No. 7,900,376 issued on Mar. 8, 2011, which claims the benefit of the filing date under 35 U.S.C. §119(e) of Provisional U.S. Patent Application Ser. No. 60/783,516, filed Mar. 17, 2006. All of the foregoing applications are hereby incorporated by reference in their entirety.

BACKGROUND

There have been numerous attempts to create stable shoes that increase energy return and reduce the impact and stress created on various parts of the human body during walking, running, jumping and other forms of motion that occur when a person uses his/her feet to travel across a surface hereinafter referred to as self-propelled locomotion.

U.S. Pat. No. 4,941,273 (Gross) uses an elastic band that stores and returns energy linearly which is not desirable for the heavier fast paced loads encountered during strenuous physical activity.

U.S. Pat. No. 6,029,374 (Herr, et al.) uses a two and three coupled spring system whereby energy is absorbed at heel and toe strike; however this invention lacks a powerful arch spring that can be used by the ball of the foot for increased performance.

U.S. Pat. No. 5,875,567 (Bayley) uses a heel spring; however this invention also lacks a powerful arch spring that can be uses by the ball of the foot for increased performance.

Other designs, which have reached the marketplace, include air bladders that are not stable, have been known to blow open and are incapable of storing relatively large amounts of energy; coil springs that are heavy and not stable which has led to injuries; and elastomers and elastomeric foams which are used as the primary shock absorbing and energy storage and return materials, but they fail to achieve the higher efficiency energy returns that are possible with spring boards.

The present invention overcomes many of the deficiencies of the previous designs by incorporating into the shoe a light weight stable design with a powerful primary spring-arch spring made from spring boards and used by the heel and ball of the foot areas to store and return energy efficiently and to help absorb shock. In addition, embodiments of the present invention allow the spring boards to extend into the toe area to be used as toe springs to enhance the energy storage and return capabilities of the shoe.

Also, it is known that while some devices are excellent for storing and returning energy, other devices are better at absorbing shock. Embodiments of the present invention utilize a primary spring system which is excellent for storing and returning energy and a shock absorbing material which can also function as a secondary spring in order to achieve high efficiency energy returns while maintaining comfort and stability with the shoe.

DRAWINGS

The accompanying drawings, which are incorporated in and constitute a part of this specification, illustrate several embodiments of the invention.

DETAILED DESCRIPTION

I have developed a novel shoe system with a combination of structures and materials, each with unique properties and purpose that increases the energy return to and reduces the impact and stress on the human body created during self propelled locomotion.

The novel shoe system consists of a primary spring system and a shock absorbing system which can also function as a secondary spring system.

The primary spring system consists of two composite and/or non-composite curves boards that have a common connection in the area of the foot called the arch. The boards can have varying degrees of thicknesses and tapers and they can be made in any shape including, but not limited to rectangular, oval and round shapes. They can also be made in any combination of shapes and made with any type of contours, curves, edges and corners. In addition, the boards are designed to flex during self-propelled locomotion so as to absorb and store energy and to return to their pre-flex shape in an efficient manner so that they efficiently return the stored energy. These boards in the shoe will hereinafter be referred to as spring boards.

The composite spring boards can be made of a resin combined with a reinforcement material which together act as a spring. The resin can be made of epoxy, polyester, plastic (including thermoplastic and thermosetting), urethane, elastomer, rubber, combinations of these materials and other types of synthetic and natural materials. Other materials including, but not limited to, metal and wood can also be combined with a reinforcement material to create a composite material which acts like a spring. The reinforcement material part of the composite spring board can be made of glass, carbon, plastic (including thermoplastic and thermosetting), Kevlar, metal, combinations of these materials and other types of synthetic and natural materials. The reinforcement materials can be made into woven or non-woven fibers, yarns and strands which form a fabric, mat or roving although other types of reinforcement material geometries are possible.

The spring boards for the shoe can also be made of a non-composite material also known as a non-reinforced flexible material for purposes of discussion here. The non-composite spring board materials include, but are not limited to epoxy, polyester, plastic (including thermoplastic and thermosetting), urethane, elastomers, rubber, wood, metal, combinations of these materials and other types of synthetic and natural materials.

Figure 1:
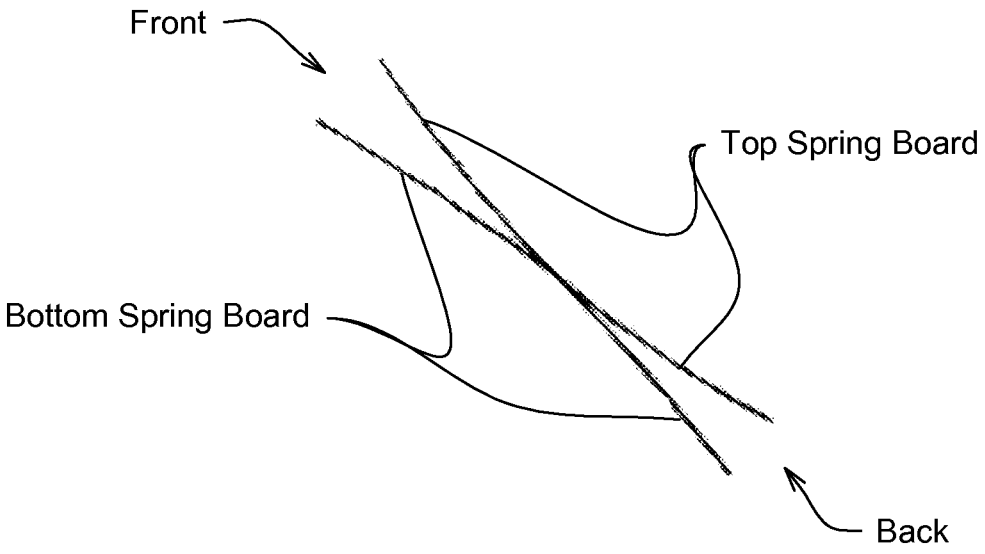
FIG. 1 shows a side view of a reverse ellipse arch spring with both a top and bottom spring board.
Figure 2:
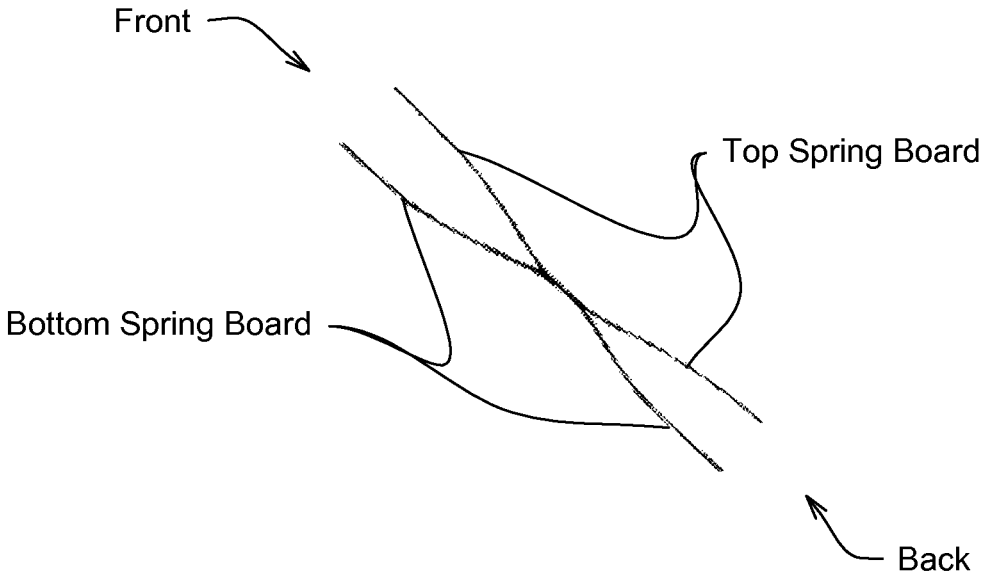
FIG. 2 shows a side view of a reverse ellipse arch spring where both the top and bottom spring boards change concavities.
Figure 3:
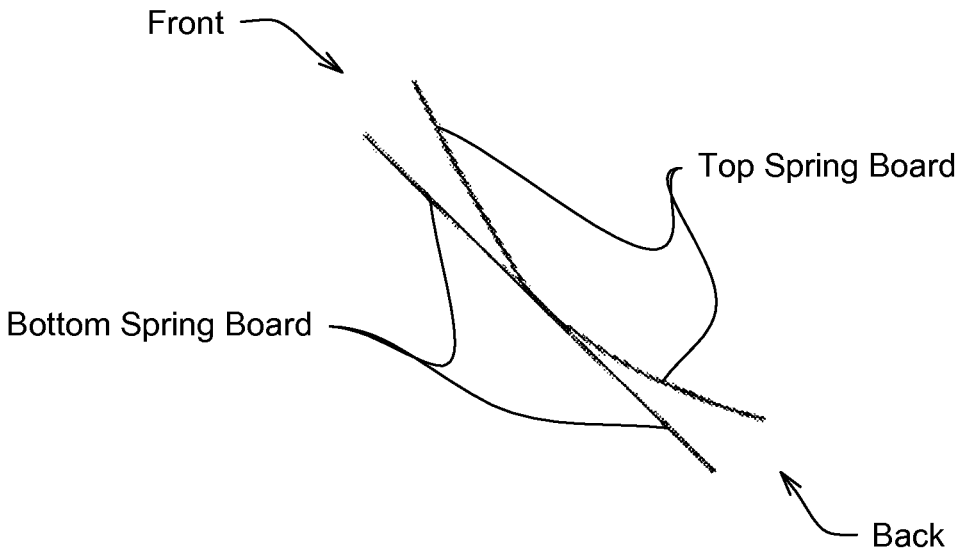
FIG. 3 shows a side view of an arch spring where the top spring board is concave up and the bottom spring board is flat.

In the area of the foot called the arch, the two spring boards are joined together to form a spring hereinafter referred to as the arch spring. Testing has shown an efficient geometry for the arch spring is that of two reverse ellipses. See FIG. 1. This design creates a very strong joint where the top and bottom spring boards are joined whether fastening them together or molding them together as a single unit. Also, in this design each ellipse pushes off (opposes) the other to maximize energy storage and return and reduce impact. FIG. 2 shows an arch spring where both spring boards have reverse concavities and FIG. 3 shows an arch spring where the bottom spring board is flat and the top spring board is concave up; thus the spring boards do not have to be mirror images of each other. It is also possible for the arch spring to have the top spring board flat and the bottom spring board concave down. Other arch spring-spring board geometries include, but are not limited to, having both spring boards concave up, both concave down and both with numerous concavity changes. They can also be very wavy to make them more flexible and give them a greater functional range of motion.

Figure 7:
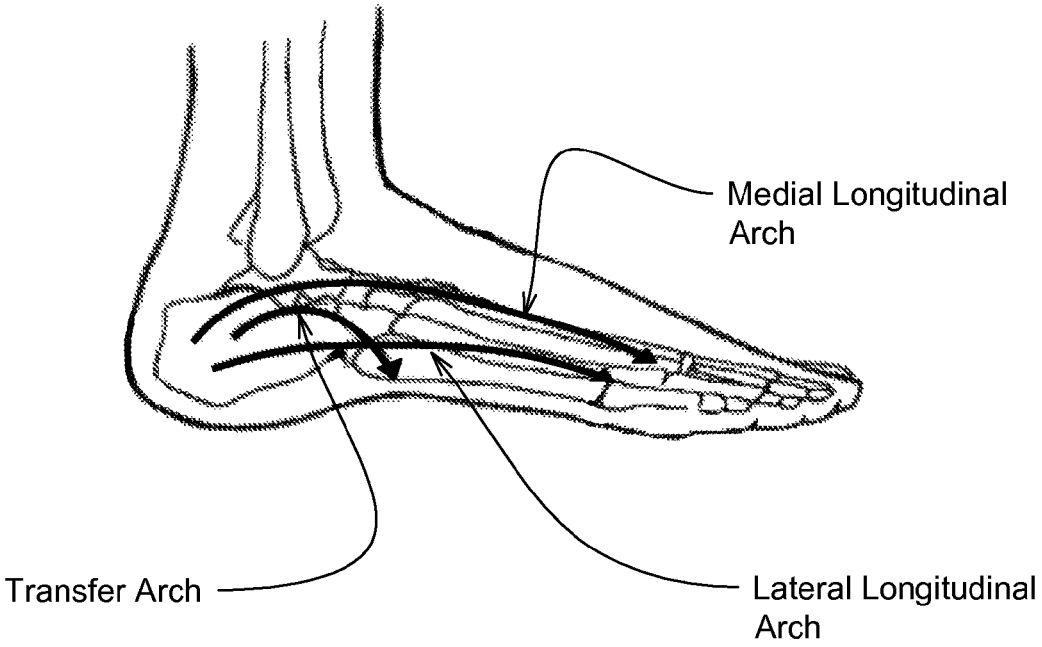
FIG. 7 shows the foot's three natural arches.

The spring boards can also be made to resemble the human foot's three natural arches. See FIG. 7. The medial longitudinal arch is the highest arch and the one many people think of as the arch of the foot. It is composed of the calcaneus, talus, navicular, cuneiforms, and the first three metatarsal bones. The lateral longitudinal arch is lower and flatter than the medial arch. It is composed of the calcaneus, cuboid and the fourth and fifth metatarsal bones. The traverse arch runs across the midfoot at a right angle to the two longitudinal arches and it is composed of the cuneiforms, the cuboid, and the five metatarsal bases. The spring boards can be curved similar to any of these three natural arches as well as any combination of them. For example, the spring boards can start with a tall curve similar to the medial longitudinal arch and taper down to a shorter curve similar to the lateral longitudinal arch; thus resembling the arch structure one sees when looking at the epidermis on the bottom of the foot that is covering the bony arch structure.

Also, the top spring board and/or the bottom spring board can be made in more than one piece. For example, if the top spring board is made in more than one piece then as many of its pieces as desired can be joined together and/or the top spring board's pieces can be individually connected to the bottom spring board and if desired the connections can be separated by a distance creating more than one arch spring-spring board axis in the arch area of the footwear. If the bottom spring board is made in more than one piece then as many of its pieces as desired can be joined together and/or the bottom spring board's pieces can be individually connected to the top spring board and if desired the connections can be separated by a distance creating more than one arch spring-spring board axis in the arch area of the footwear. If both top and the bottom spring boards are both made in more than one piece then as many of the top spring board pieces as desired can be joined together and as many of the bottom spring board pieces as desired can be joined together and/or the top and bottom spring board's pieces can be connected to the bottom and top spring board pieces respectively and individually and if desired the connections can be separated by a distance creating more than one arch spring-spring board axis in the arch area of the footwear.

The spring board designed to be pushed directly or indirectly by the heel and the ball of the foot, causing it to flex, will be called the top spring board and the spring board designed to be pushed directly or indirectly by the surface over which self-propelled locomotion is occurring, causing it to flex, will be called the bottom spring board for purposed of illustration and discussion here. See FIGS. 4A and 4B (for a cut out of the spring board in FIG. 4A). Also, the surface over which self-propelled locomotion is occurring and which causes the bottom spring board to flex will be called the traveling surface.

In addition, for purposes of illustration and discussion here, the front/forward area of the novel shoe is the area between, and including, the center of the arch spring joint (hereinafter described) and the end of the shoe closest to the toes of the foot. The back/rear area of the shoe is the area that is between, and including, the center of the arch spring, joint and the end of the shoe closest to the heel of the foot. See FIG. 4A.

Also, the bottom spring board can extend more or less farther forward or rearward in the shoe than the top spring board and the top spring board can extend more or less farther forward or rearward in the shoe than the bottom spring board in all areas of the novel shoe in order to achieve various desired results. In addition, in all areas of the novel shoe the concavity of both the top and bottom spring boards can change once, numerous times or not at all. Furthermore, the spring boards can be made with continuous curves or sharp bends or corners in order to achieve various desired results.

Both top and bottom spring boards will extend from the arch spring joint back towards the heel of the foot area and be separated by a distance when in their shoe resting shapes to create a heel spring. They will extend to the heel area of the foot far enough so that when a person lands with his/her heel he/she will cause the top and bottom spring boards to move towards each other in the section of the spring that is rearward of the arch spring joint. See FIGS. 4A and 4B.

Figure 5:
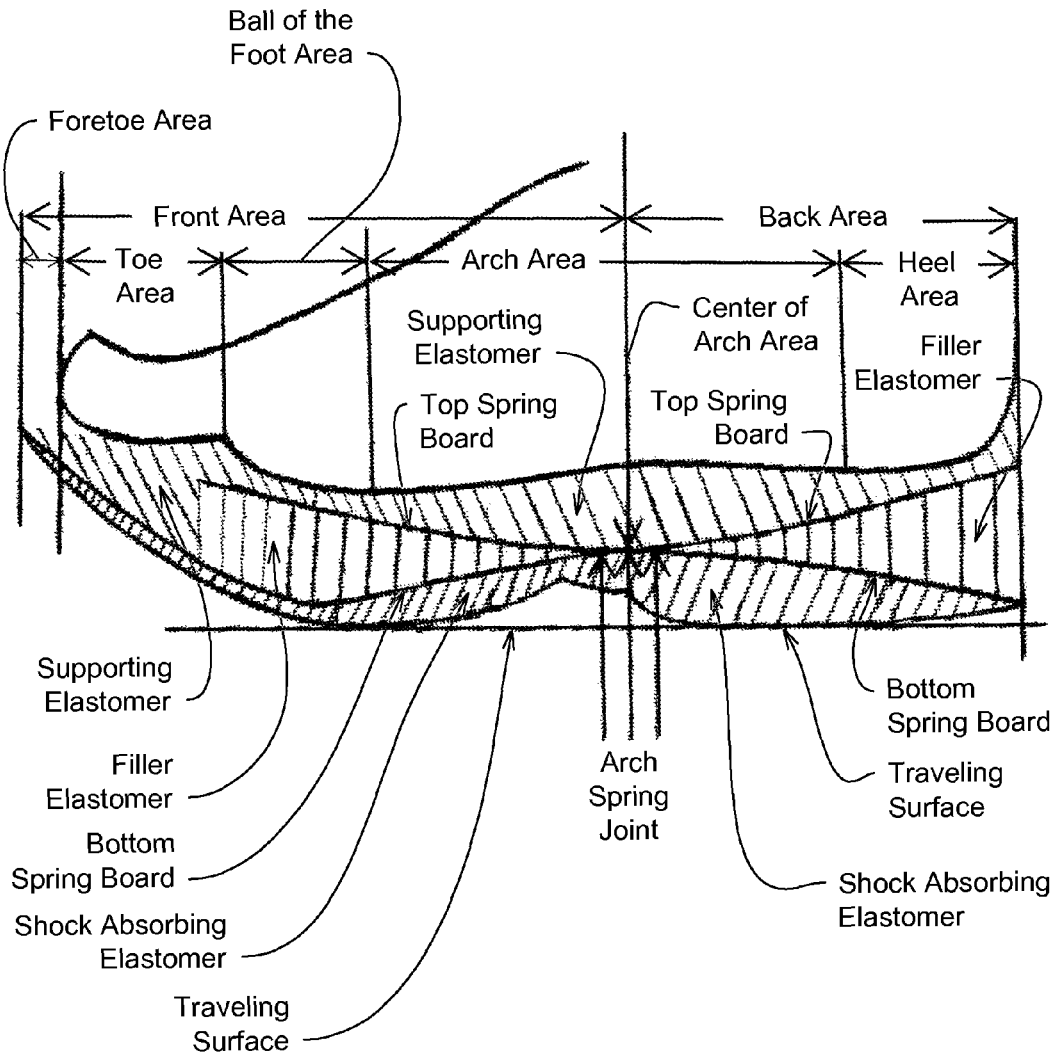
FIG. 5 shows a side view of various areas of the novel shoe and another embodiment of a primary spring consisting of an arch spring joint and top and bottom spring boards extending from the heel area to the ball of the foot area of the novel shoe. Also shown is an embodiment of several elastomers serving different functions in the novel shoe.

The heads of the five metatarsal bones are generally considered the ball of the foot. For purposes of discussion here, the ball of the foot area will also include the area of the flesh that wraps around the ball of the foot. Both the top and bottom spring boards will extend from the arch spring joint forward to at least the beginning of the ball of the foot area and be separated by a distance when in their shoe resting shapes to create a ball of the foot spring. They will extend to the ball of the foot area far enough so that when a person lands with his/her ball of the foot he/she will cause the top and bottom spring boards to move towards each other in the section of the spring that is forward of the arch spring joint. The spring boards can extend forward beyond the ball of the foot area into the toe area and beyond to achieve various desired results, but this is not a requirement for the novel shoe. FIG. 5 shows both spring boards extending forward into the ball of the foot area of the shoe, but no further. Whenever the spring boards do not run completely to the front or back ends of the shoe, flexible shock absorbing and supporting elastomer(s) can run from where the spring boards end to the end(s) of the shoe to provide a secondary spring, protection and support for the foot and contact with the traveling surface. In FIG. 5, a flexible shock absorbing elastomer, which doubles as a secondary spring, runs along the bottom of the shoe from the back end to the front end of the shoe. It continues to run to the front end of the shoe beyond the ball of the foot area where the bottom spring board ends. A flexible supporting elastomer is used between this flexible shock absorbing elastomer and the toes to give the toes support. In this example, as a person wearing the novel shoe lands on or rolls onto their toes, the shock absorbing and toe supporting flexible elastomers will bend to facilitate the natural toe movement that occurs during self propelled locomotion. Also, as this person pushes off with or rolls off their toes to move across the traveling surface they will release the pressure on the flexible shock absorbing elastomer which doubles as a secondary spring and it will rebound and return energy it has stored to the person wearing the shoe.

Figure 4A:
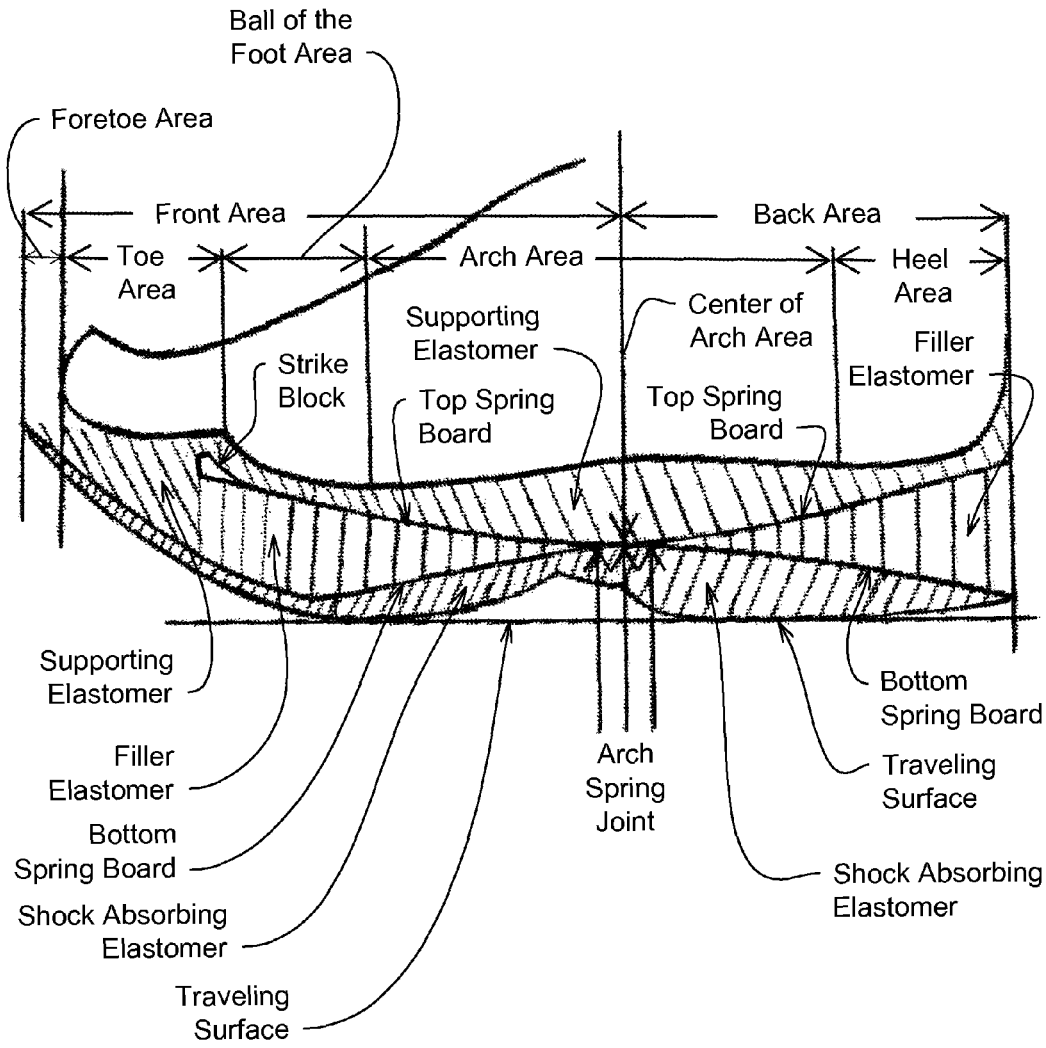
FIG. 4A shows a side view of various areas of the novel shoe and an embodiment of a primary spring with an arch spring joint and top and bottom spring boards. Also shown is an embodiment of several elastomers serving different functions in the novel shoe.
Figure 4B:
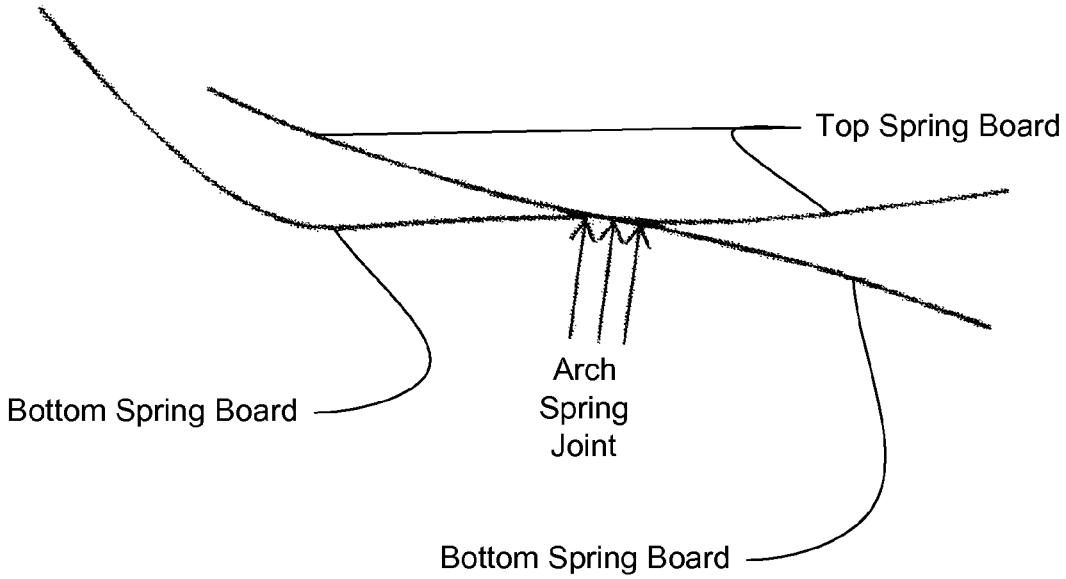
FIG. 4B shows a side view of the primary spring board in FIG. 4A.

FIG. 4A shows both the top and bottom spring boards extending forward beyond the ball of the foot area. In this figure, the top spring board extends forward into the toes area of the shoe and the bottom spring board extends forward beyond the toe area of the shoe into the fore-toe area. For purposes of discussion here, the fore-toe area will be considered any area in the shoe that is forward from where the toes end. When the spring board(s) extend into the fore-toe area of the shoe they can be used by people kicking balls, etc. or landing on the tips or front of their toes where spring action may be desirable. The shoe in FIG. 4A allows for more primary spring in the forward area of the shoe compared to the shoe in FIG. 5; however both designs allow for natural foot flexion.

Figure 6:
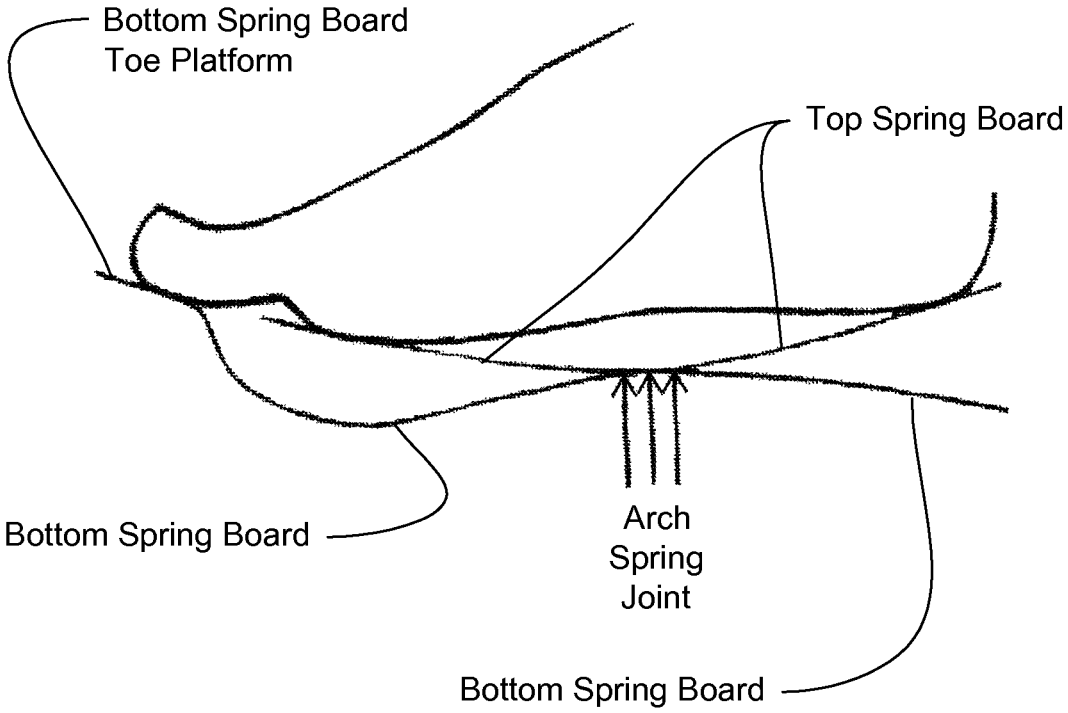
FIG. 6 shows another embodiment of a primary spring for the novel shoe where the bottom spring board extends upward to become a platform or base of a platform shaped to the lines of the toes.

The bottom spring board can also extend forward out of the ball of the foot area and upward in the toe area to become a platform or base of a platform shaped to the lines of the toes. See FIG. 6. Alternatively, the bottom spring board can extend forward out of the ball of the foot area into the toe area without becoming a platform shaped to the lines of the toes. See FIGS. 4A and 4B. When the bottom spring board extends into the toe area or beyond and a person lands on it by landing on or rolling onto their toes, the bottom spring board will be pushed upward by the traveling surface. This bending of the bottom spring board will help absorb any shock that occurs and store energy. Also, when the bottom spring board bends upward it will push upward on the toes either directly or indirectly. For example, in FIG. 4A the bottom spring board will bush upward on the toes indirectly via the supporting elastomer. This will cause the toes to hinge on the ball of the foot which facilitates the natural movement of the foot that occurs during self propelled locomotion.

Furthermore and more generally, when a person is engaged in self-propelled locomotion with their feet, they will usually attempt to strike a surface or roll against a surface with their heel, ball of the foot, toes or a combination of these foot structures and then push off with or roll their feet towards the next point of impact. When a person wearing the novel shoe shown in FIG. 4A engages in this type of self-propelled locomotion, the spring boards will deflect in order to help absorb any shock that occurs and store energy. As a person pushes off with or rolls their feet to move across the traveling surface they will release the pressure on the spring boards and the spring boards will rebound and return the energy they stored to the person wearing the shoe.

In addition, many people engage in forward walking or running by striking the ground with their heel first and then rolling forward onto their ball of the foot and toes. In this form of self-propelled locomotion, the wearer of the novel shoe will apply pressure to both the front and back of the top and/or bottom spring boards at the same time for at least part of the time he/she is making contact with the traveling surface. This reduces the prying pressure on the arch spring joint compared to when he/she is applying pressure to only the front or back of the spring boards. This reduced prying pressure on the arch spring joint gives it a greater cycle life; hence less material will be needed for strength there and a smaller arch spring joint can be utilized. Thus the shoe can be made lighter and the spring boards can run for longer distances before meeting each other at the arch spring joint where they are attached to each other. This allows for a better spring design for the shoe since more space can be utilized for the spring boards to move and act as springs and less space is needed to hold the spring boards together which constrains the spring mechanism.

Whenever the top and bottom spring boards are shaped in such a manner that they do not provide a good shape for a resting area or surface of contact for the foot (both hereinafter referred to as support shape for the foot), a flexible support elastomer can be used to provide a good support shape for the foot. FIG. 4A shows a foot resting on a flexible support elastomer that runs from the back end of the shoe to the front end of the shoe. The supporting flexible elastomer can be made of, but is not limited to, plastic, urethane, rubber, combinations of these materials and their foam and solid states. Also, two or more of the same or different flexible support elastomers can be layered/laminated one on top of the other to achieve the desired support for the foot. In addition, blocks can be strategically positioned in the shoe to provide additional support for the foot. (Make this sentence part of a claim) FIG. 4A shows a supporting strike block attached to the top spring board toward the front of the ball of the foot area. This particular strike block also extends into the toe area. The strike block in FIG. 4A will help hold the foot in place on the top spring board when both the foot and hence the shoe are at a forward tilting angle relative to the ground and the ball of the foot is striking the top spring board as might occur when someone is running on the balls of their feet. The support blocks can be made of, but are not limited to, plastic, urethane, rubber, combinations of these materials and their foam and solid states. If desired, the spring boards themselves can also be curved to provide support for the foot and the shoe.

In the novel shoe, one of the spring boards can be made less stiff than the other spring board so that it flexes more than the stiffer spring board during self-propelled locomotion. Also, one of the spring boards can be made rigid or semi-rigid so that the other spring board does all of or the vast majority of the flexing. This can be of benefit to people with foot problems where rigid orthodics are desirable. In such a case, the top platform can be made rigid and the bottom platform made to do all of or nearly all of the flexing. Furthermore the materials, thicknesses, tapers and the shapes of the spring boards can be made for the best combination of comfort, shock absorption and energy storage and return for a person needing to adapt the novel shoe to their medical condition.

The spring boards' shapes in the novel shoe when said novel shoe is ready for wearing on the foot or as a prosthesis and no external forces are acting upon said novel shoe will hereinafter be referred to as the spring boards' shoe resting shapes. One or both spring boards can be made with exaggerated curves beyond what will be their shoe resting shapes, then moved to their shoe resting shapes and held there by elastomer(s), wire(s) or other means to pre-load the spring boards. The pre-loaded spring boards will already have a load applied to them when they are incorporated into the shoe and it will take a load greater than the pre-applied load to move the spring boards further than their shoe resting shapes. Preloading the spring boards can make them feel softer to the wearer of the shoe because they will bend with less pressure once the pre-loaded weight is surpassed compared to spring boards with the same shoe resting shape that are not preloaded so they must be made stiffer to handle the same load.

The spring boards herein described are very good at deflecting and rebounding to store and return energy and they are good at absorbing some of the shock that can occur during self-propelled locomotion; thus making them an excellent primary spring system for the novel shoe. I also employ a shock absorbing system in the novel shoe to improve the comfort of the shoe for the wearer during the initial impact with the traveling surface. The shock absorbing system can be made of an elastomer material designed to compress and flex to absorb shock and store energy and to rebound to return energy to the wearer of the shoe so that it functions as a secondary spring. For example, see the flexible shock absorbing elastomer running along the bottom of the shoe in FIG. 4A. Also, more than one flexible shock absorbing elastomer can be used in the novel shoe. This can be beneficial to handle the different stresses created by the different parts of the feet, to handle different types of activities or to give the shoe a better feel to the person that wears it. The flexible shock absorbing elastomer can be made of materials including, but not limited to urethanes, plastics, rubbers, combinations of these materials and their foam and solid states. If desired the flexible shock absorbing elastomer can also function as a flexible support elastomer for the foot. This can be beneficial to the wearer of the shoe when the spring boards are designed to be effective springs for the shoe, but the spring board design does not have the best contours and shapes for conforming to and providing the best comfort for the foot.

The flexible shock absorbing elastomer can be situated anywhere in the shoe in order to help protect the foot and/or the shoe from impact and it can also be situated and shaped as part of the shoe for aesthetic purposes to help sell the shoe.

In addition a filler elastomer can be used to fill the space between the top and bottom spring boards or anywhere else in the shoe to keep debris and other undesirable things out of the shoe. See FIG. 4A. A filler elastomer can be extremely low density and light weight since its primary purpose is to fill up space to keep debris out of the shoe rather than functioning primarily to offer support, shock protection and/or efficient energy return; although it is desirable for the filler elastomer to be resilient so it offers support, shock protection and/or efficient energy return where appropriate rather than hindering it. Also, it is possible to encase the spring boards in a skin to keep debris out, where the skin can be flexible or elastic and may or may not entrap a gas, liquid or solid including, but not limited to, air or a gel. If a gas, liquid or solid entrapment scheme is employed between the spring boards or anywhere else in the shoe, the trapped matter can function as a shock absorber and/or secondary spring for the shoe. Also, the protective skin encasement can be vented or made of a type of filter material so as to keep out larger particles and debris while allowing air or liquid to be pushed or expelled from, then drawn back into the skin encasement as the spring boards flex.

Other materials that are better designed for traction, frictional wear and tear, puncture resistance, etc. can be applied to the bottom of or around the shoe to protect any of the other components of the shoe including the spring boards or secondary spring materials which might otherwise make direct contact with the traveling surface or the elements and be subject to abuse they are not designed for. In addition, materials other than spring board and secondary spring materials can be used for the top of the shoe sole where properties other than energy return may be important. For example, a fuzzy surface that feels good to the skin, a material designed for the absorption of sweat or memory foams used in beds and pillows that conforms to a person's body may be desirable for the top of the sole. These and other top sole surfaces may not be as good as the novel spring board and secondary spring system for efficient energy return, but they provide other properties to the shoe that may be desirable to the wearer of the shoe.

An energy storage and return device for footwear comprising: a primary spring system made of two spring boards, a top and a bottom, that are connected to each other in one or more than one area to form one or more spring board axes; wherein said connection(s) will be positioned in the arch area of the footwear; wherein said spring boards and one or more spring board axes are elements of one or more springs; wherein both top and bottom spring boards extend from their connection(s) in the arch area of the footwear into both the heel and ball of the foot areas of the footwear such that both spring boards have one or more areas where they are not directly touching each other in the arch, heel and ball of the foot areas of the footwear; wherein the top and bottom spring boards are capable of bending towards each other in the arch, heel and/or ball of the foot areas of the footwear to store energy; wherein after both spring boards bend towards each other, due to external force(s), to store energy in the arch, heel and/or ball of the foot areas of the footwear, they are capable of bending away from each other to release stored energy as the external force(s) are transferred to and/or removed from the spring boards.

The energy storage and return device wherein the top spring board and/or the bottom spring board are made in more than one piece; wherein if the top spring board is made in more than one piece then as many of its pieces as desired can be joined together and/or the top spring board's pieces can be individually connected to the bottom spring board and if desired the connections can be separated by a distance creating more than one spring board axis in the arch area of the footwear. Wherein, if the bottom spring board is made in more than one piece then as many of its pieces as desired can be joined together and/or the bottom spring board's pieces can be individually connected to the top spring board and if desired the connections can be separated by a distance creating more than one spring board axis in the arch area of the footwear. Wherein, if both top and the bottom spring boards are made in more than one piece then as many of the top spring board pieces as desired can be joined together and as many of the bottom spring board pieces as desired can be joined together and/or the top and bottom spring board pieces can be connected to the bottom and top spring board pieces respectively and individually and if desired the connections can be separated by a distance creating more than one spring board axis in the arch area of the footwear.

The energy storage and return device where both spring boards bend towards each other with a rising rate.

The energy storage and return device wherein a secondary spring will be integrated into the footwear; wherein the secondary spring will be one or more than one flexible, compressible and resilient material capable of absorbing shock and storing and returning energy; wherein the secondary spring material can be integrated into the footwear anywhere in order to assist the primary spring system in absorbing shock and storing and returning energy.

The energy storage and return device wherein a secondary spring will be integrated into the footwear; wherein said secondary spring will be a flexible, compressible and resilient material capable of absorbing shock and storing and returning energy; wherein said secondary spring can be the primary shock absorber and energy storage and return device in the area of the footwear forward or rearward from where one or both of the spring boards end in the footwear.

The energy storage and return device where one of both spring boards are bare in one or more areas such that they can come into direct contact with the traveling surface and/or one or both feet of the person wearing the footwear made with said energy storage and return device.

The energy storage and return device wherein the top and bottom spring boards are molded together as a single unit.

The energy storage and return device where block(s) can be strategically positioned on the spring boards and/or elsewhere in the footwear to provide additional support for the foot.

The energy storage and return device, where either the top spring board, the bottom spring board or both, extend forward beyond the ball of the foot area of the footwear into the toe area of the footwear; wherein if both spring boards extend into the toe area of the footwear, then one or more areas exists between both spring boards in said toe area where they are not directly touching each other; wherein if the top spring board extends into the toe area of the footwear, then it is capable of bending to store energy in said toe area; wherein if the bottom spring board extends into the toe area of the footwear, then it is capable of bending to store energy in said toe area; wherein after one of both spring boards bend, due to external force(s), to store energy in said toe area, they are capable of bending in the opposite direction to release stored energy as the external force(s) are transferred to and/or removed from the spring boards.

The energy storage and return device wherein a secondary spring will be integrated into the footwear; wherein the secondary spring will be one or more than one flexible, compressible and resilient material capable of absorbing shock and storing and returning energy; wherein the secondary spring material can be integrated into the footwear anywhere in order to assist the primary spring system in absorbing shock and storing and returning energy.

The energy storage and return device wherein a secondary spring will be integrated into the footwear; wherein said secondary spring will be a flexible, compressible and resilient material capable of absorbing shock and storing and returning energy; wherein said secondary spring can be the primary shock absorber and energy storage and return device in the area of the footwear forward or rearward from where one or both of the spring boards end in the footwear.

The energy storage and return device, where either the top spring board, the bottom spring board or both, extend forward beyond the toe area of the footwear into the fore-toe area of the footwear; wherein if both spring boards extend into the fore-toe area of the footwear, then one or more areas exists between both spring boards in said fore-toe area where they are not directly touching each other; wherein if the top spring board extends into the fore-toe area of the footwear, then it is capable of bending to store energy in said fore-toe area; wherein if the bottom spring board extends into the fore-toe area of the footwear; wherein after one or both spring boards bend, due to external force(s), to store energy in said fore-toe area, they are capable of bending in the opposite direction to release stored energy as the external force(s) are transferred to and/or removed from the spring boards.

The energy storage and return device wherein a secondary spring will be integrated into the footwear; wherein said secondary spring will be one or more than one flexible, compressible and resilient material capable of absorbing shock and storing and returning energy; wherein said secondary spring material can be integrated into the footwear anywhere in order to assist the primary spring system in absorbing shock and storing and returning energy.

The energy storage and return device wherein a secondary spring will be integrated into the footwear; wherein said secondary spring will be a flexible, compressible and resilient material capable of absorbing shock and storing and returning energy; wherein said secondary spring can be the primary shock absorber and energy storage and return device in the area of the footwear forward or rearward from where one or both of the spring boards end in the footwear.

The energy storage and return device where the bottom spring board rises up to become a platform for one or more toes; wherein said bottom spring board toe(s) platform may rise higher in the footwear than the top spring board.

I claim:

1. In a footwear comprising a toe area, a ball of the foot area, an arch area, and a heel area; and energy storage and return system for the footwear, the system comprising:

a top spring board and a bottom spring board;

the top spring board concave up in the arch area;

the top spring board and the bottom spring board fixedly connected to each other in at least the arch area to form at least one spring board axis; and wherein at least one of the top spring board and the bottom spring board further include a shock absorbing elastomer or foam;

wherein, when the footwear is in a resting shape, the top spring board extends from the spring board axis into both the heel area and the ball of the foot areas of the footwear such that the top spring board does not directly contact the bottom spring board in at least two of the area forward of the spring board axis, arch area rearward of the spring board axis, heel area, and the ball of the foot area of the footwear;

wherein, upon an impact, the top spring board is capable of reboundably bending toward the bottom spring board in at least two of the arch area forward of the spring board axis, arch area rearward of the spring board axis, the heel area, and the ball of the foot area of the footwear; and wherein, upon an impact, the bottom spring board is capable of reboundably bending toward the top spring board in at least two of the arch area forward of the spring board axis, arch area rearward of the spring board axis, the heel area, and the ball of the foot area of the footwear.

2. The energy storage and return system of claim 1, wherein the shock absorbing elastomer or foam is connected to at least one of the top of the top spring board, the bottom of the top spring board, the top of the bottom spring board and the bottom of the bottom spring board.

3. The energy storage and return device of claim 1, wherein the top spring board and the bottom spring board are pre loaded.

4. The energy storage and return system of claim 1, wherein the shock absorbing elastomer is connected to the bottom springboard in the heel area.

5. The energy storage and return system of claim 1, wherein the shock absorbing elastomer is connected to the bottom springboard in a ball of foot area.

6. The energy storage and return system of claim 1, wherein the shock absorbing elastomer is connected to the bottom springboard in an arch area.

7. The energy storage and return device of claim 1, wherein at least one of the top spring board or the bottom spring board further comprise a secondary spring.

8. In a footwear comprising a toe area, a ball of the foot area, an arch area, and a heel area; and energy storage and return system for the footwear, the system comprising:

a top spring board and a bottom spring board;

the top spring board concave up in the arch area;

the bottom spring board is concave down;

the top spring board and the bottom spring board fixedly connected to each other in at least the arch area to form at least one spring board axis, the connection connecting substantially at the apex of the concave up of the top spring board to substantially at the apex of the concave down of the bottom spring board; and wherein when the footwear is in a resting shape, the top spring board extends from the spring board axis into both the heel area and the ball of the foot areas of the footwear such that the top spring board does not directly contact the bottom spring board in at least two of the arch area forward of the spring board axis, arch area rearward of the spring board axis, heel area, and the ball of the foot area of the footwear;

wherein, upon an impact, the top spring board is capable of reboundably bending toward the bottom spring board in at least two of the arch area forward of the spring board axis, the arch area rearward of the spring board axis, the heel area, and the ball of the foot area of the footwear; and wherein, upon an impact, the bottom spring board is capable of reboundably bending toward the top spring board in at least two of the arch area forward of the spring board axis, arch area rearward of the spring board axis, the heel area, and the ball of the foot.

9. The energy storage and return system of claim 8 wherein the top spring board changes concavity at least once in at least one of in the heel area, the arch area and the ball of the foot area.

10. The energy storage and return system of claim 8 wherein at least one of the top spring board and the bottom spring board have varying degrees of thicknesses.

11. The energy storage and return system of claim 8 wherein the top spring board further comprises a first side and a second side and wherein the bottom spring board further comprises a first side and a second side and wherein each of the first side and the second side comprise a concavity.

12. The energy storage and return system of claim 8 wherein the bottom spring board is confined to the arch area of the footwear.

13. The energy storage and return system of claim 8 wherein the bottom spring board runs from the heel area to at least one of the ball of the foot area and the toe area.

14. The energy storage and return system of claim 8 wherein the top spring board changes concavity at least once in the ball of the foot area.

15. The energy storage and return system of claim 8 wherein at least one of the top spring board and the bottom spring board are tapered.

16. The energy storage and return system of claim 8 wherein the top spring board changes concavity at least once in the arch area.

17. The energy storage and return system of claim 8 wherein the top spring board and the bottom spring board are preloaded.

* * * * *